US009038618B1

(12) United States Patent
Bomar

(10) Patent No.: US 9,038,618 B1
(45) Date of Patent: May 26, 2015

(54) MECHANISMS AND METHODS FOR STABILIZING ARCHERY BOWS

(71) Applicant: Scott Bomar, Tehachapi, CA (US)

(72) Inventor: Scott Bomar, Tehachapi, CA (US)

( * ) Notice: Subject to any disclaimer, the term of this patent is extended or adjusted under 35 U.S.C. 154(b) by 0 days.

(21) Appl. No.: 14/252,269

(22) Filed: Apr. 14, 2014

Related U.S. Application Data

(60) Provisional application No. 61/936,789, filed on Feb. 6, 2014.

(51) Int. Cl.
*F41B 5/20* (2006.01)
*F41B 5/14* (2006.01)

(52) U.S. Cl.
CPC ..... *F41B 5/1426* (2013.01)

(58) Field of Classification Search
CPC ..... F41B 5/1426
USPC ..... 124/86, 88, 89
See application file for complete search history.

(56) References Cited

U.S. PATENT DOCUMENTS 3,196,860 A * 7/1965 Hoyt, Jr. ..... 124/89
3,342,172 A * 9/1967 Sanders ..... 124/23.1
3,412,725 A * 11/1968 Hoyt, Jr. ..... 124/84
3,502,062 A * 3/1970 Shurts ..... 124/23.1
3,589,350 A * 6/1971 Hoyt et al. ..... 124/89
3,628,520 A * 12/1971 Izuta ..... 124/89
3,683,883 A * 8/1972 Izuta ..... 124/89
4,054,121 A * 10/1977 Hoyt, Jr. ..... 124/89
4,245,612 A * 1/1981 Finlay ..... 124/89
4,478,204 A * 10/1984 Kocsan ..... 124/89
4,570,608 A * 2/1986 Masterfield ..... 124/89
4,660,538 A * 4/1987 Burgard ..... 124/89
4,779,602 A * 10/1988 Hess, Sr. ..... 124/89
4,893,606 A * 1/1990 Sisko ..... 124/89
4,907,567 A * 3/1990 Henrich ..... 124/89
4,955,356 A * 9/1990 Pike et al. ..... 124/89
4,957,095 A * 9/1990 Cameron ..... 124/89
5,016,602 A * 5/1991 Mizek ..... 124/89
5,090,396 A * 2/1992 Bickel et al. ..... 124/89
5,205,272 A * 4/1993 Boyer ..... 124/89
5,239,977 A * 8/1993 Thomas ..... 124/89
5,273,022 A * 12/1993 Leven ..... 124/89
5,320,085 A * 6/1994 Hanneman ..... 124/89
5,370,104 A * 12/1994 Neie ..... 124/89
5,388,563 A * 2/1995 Hsu ..... 124/23.1
5,390,656 A * 2/1995 Villa et al. ..... 124/89
5,460,156 A * 10/1995 Sappington ..... 124/89
5,471,969 A * 12/1995 McDonald, Jr. ..... 124/89
5,487,375 A * 1/1996 McDonald, Jr. ..... 124/89
5,511,533 A * 4/1996 Waller ..... 124/89
5,524,602 A * 6/1996 Papandrea et al. ..... 124/89
5,584,282 A * 12/1996 McDonald, Jr. ..... 124/89
5,595,169 A * 1/1997 Brown, Jr. ..... 124/89
5,611,325 A * 3/1997 Kudlacek ..... 124/89

(Continued)

*Primary Examiner* — Melba Bumgarner
*Assistant Examiner* — Alexander Niconovich
(74) *Attorney, Agent, or Firm* — James M. Duncan, Esq.; Klein DeNatale Goldner

(57) ABSTRACT

An archery stabilizer which, by utilizing a carbon fiber tube or a comparable material in a tube configuration, provides for preloading the tube in compression, thereby effectively increasing the stiffness of the tube. The stabilizer includes weights, and the preloading of the tube compensates for the bending moment applied to the tube by the weights attached to the end of the tube or contained within the tube. In effect, the present invention presents an apparatus and method for loading the tube so as to allow a user to adjust the elastic modulus of the tube.

14 Claims, 8 Drawing Sheets

(56) References Cited

U.S. PATENT DOCUMENTS

| | | | | | |
|---|---|---|---|---|---|
| 5,615,664 | A * | 4/1997 | McDonald, Jr. | 124/89 |
| 5,617,664 | A * | 4/1997 | Troncoso | 42/1.06 |
| 5,649,527 | A * | 7/1997 | Olsen et al. | 124/89 |
| 5,669,370 | A * | 9/1997 | Breedlove | 124/89 |
| 5,735,257 | A * | 4/1998 | Walk | 124/89 |
| 5,975,070 | A * | 11/1999 | Sands | 124/89 |
| 5,996,570 | A * | 12/1999 | Legate | 124/89 |
| 6,021,770 | A * | 2/2000 | Sodaro | 124/89 |
| 6,186,135 | B1 * | 2/2001 | Harwath et al. | 124/89 |
| 6,283,109 | B1 * | 9/2001 | Wiseby et al. | 124/89 |
| 6,494,196 | B2 * | 12/2002 | Harwath et al. | 124/89 |
| 6,588,414 | B2 * | 7/2003 | McMillan, III | 124/89 |
| 6,802,307 | B2 * | 10/2004 | Leven | 124/89 |
| 6,817,352 | B1 * | 11/2004 | Saunders | 124/89 |
| 7,213,590 | B2 * | 5/2007 | Pellerite | 124/89 |
| 7,954,481 | B2 * | 6/2011 | Barnard | 124/88 |
| 8,220,448 | B1 * | 7/2012 | Moggo | 124/89 |
| 8,347,870 | B1 * | 1/2013 | Mahutga | 124/89 |
| 8,695,581 | B2 * | 4/2014 | Felt et al. | 124/89 |
| 8,701,645 | B2 * | 4/2014 | Stokes | 124/89 |
| 2006/0283435 | A1 * | 12/2006 | Pellerite | 124/89 |
| 2010/0192932 | A1 * | 8/2010 | Brewster | 124/89 |

* cited by examiner

MECHANISMS AND METHODS FOR STABILIZING ARCHERY BOWS

RELATED APPLICATIONS

U.S. Application No. 61/936,789 for this invention was filed on Feb. 6, 2014, for which application these inventors claims domestic priority, and which application is incorporated in its entirety.

BACKGROUND OF THE INVENTION

This invention relates to archery bows, and stabilizers for the same, and more particularly to devices and methods which provide for a smoother release of an arrow and therefore greater accuracy in casting the arrow towards the target.

A number of references identify the vibration of an archery bow which occurs when the bow string is released. Many of these references refer to the discomfort to the archer from the bow vibration and the noise produced by the bow. However, another issue is the impact of the vibration as the arrow is cast toward the target. Particularly with competitive archery, a small impact on the trajectory of an arrow as it leaves the bow can have a relatively significant impact on the ultimate accuracy of the shot.

One solution for stabilizing a bow is to utilize a forwardly extending tube attached to the bow, where weights are typically affixed to the end of the tube away from the bow to balance the bow as the bow string is drawn and released. Alternatively, the weights may be contained within the body of the stabilizer. The weight acts as a counterbalance and maintains the stability of the bow as it is being shot. By necessity, stabilizers add weight to the bow. Because of the increase in weight, the stabilizer bodies are frequently made from lighter materials such as carbon fiber, ABS plastic and similar materials to make the body as light and rigid as possible. Because of the potential impact of wind impacting the stabilizer, it is also desirable to maintain a smaller diameter of tube.

The stabilizer may be adjusted by, among other means, by the amount of weight affixed to the end of the stabilizer tube or, alternatively, contained within the tube or tube extension. The stabilizer may also be adjusted by the length of the tube. It is to be appreciated however that a moment arm is created by the amount of weight and the effective length of the tube. The tube must have sufficient stiffness such that there is minimal flex in the tube. Otherwise, subtle movements of the archer will cause the weight at the end of the tube to oscillate, making the bow more difficult to aim and shoot accurately.

Tubes manufactured from composite materials such as carbon-fiber-reinforced polymer, carbon-fiber-reinforced plastic, carbon-fiber reinforced thermoplastic, etc. (hereinafter collectively referred to as "carbon fiber") have directional strength properties which depend upon the layout of the carbon fiber, which means the stiffness of the tube is not consistent in all directions. While it is possible to manufacture tubes which have overlapping layers of carbon fiber to provide sufficient stiffness to resist deflection in all directions, the overlapping layers increase the diameter of the tube as well as the manufacturing expense.

Thus, a stabilizer which provides sufficient weight to maintain the balance of the bow, supports the weight on and/or within the stabilizer with minimal flex, is lightweight, has a small diameter tube, and which may be tuned to the individual preferences of an archer is highly desirable.

SUMMARY OF THE INVENTION

Embodiments of the method and apparatus disclosed herein provide a solution to the needs described above. The present invention is an archery stabilizer which, utilizing a carbon fiber tube or comparable material, will preload the tube in compression, thereby effectively increasing the stiffness of the tube. Thus, the bending moment applied to the tube by the weights attached to the end of the tube or contained within a tube, is compensated by the preload applied to the tube. In effect, the present invention loads the tube so as to provide consistent stiffness in all directions. Said differently, the present invention allows a user to adjust the elastic modulus of the tube.

An embodiment of the presently disclosed stabilizer comprises a tube, typically of carbon fiber construction, an axial load member which is inserted within the tube, a first end member which attaches to the bow end of the tube, a second end member which attaches to the weight end of the tube, wherein the axial load member spans between the first end member and the second end member. In one embodiment of the stabilizer, the first end member or the second member comprises an integral adjustment mechanism. This adjustment mechanism may be adjusted to increase or decrease tension in the axial load member, where an increase in tension in the axial load member increases the compressive load applied to the tube, and a decrease in in tension reduces the compressive load applied to the tube. Thus, when it is desirable to increase the stiffness of the tube, the adjustment mechanism is manipulated to apply greater compression to the tube.

In another embodiment, the weights are integral to be stabilizer. This embodiment also comprises a tube, typically of carbon fiber construction, having an axial load member inserted within the tube. A first end member attaches to the bow end of the tube and a second end member contained within a tube extension. The tube extension contains weights. The axial load member spans between the first end member and the second end member. In this embodiment, an adjustment mechanism is disposed between the axial load member and either the first end member or the second end member. This adjustment mechanism may be adjusted to increase or decrease tension in the axial load member, where an increase in tension in the axial load member increases the compressive load applied to the tube, and a decrease in in tension reduces the compressive load applied to the tube. Thus, when it is desirable to increase the stiffness of the tube, the adjustment mechanism is manipulated to apply greater compression to the tube. The tube extension may be sized as desired to contain the optimal weight.

The combination of the first and second end members, the adjustment mechanism, and the tube, provides a major component of a bow stabilizer. Weights are applied to the tube as by current practice, but adjusting the compressive loads applied to the tube provides a tuneable stabilizer which may be adjusted according to the individual preferences of the archer. Thus a method of stabilizing a bow comprises the attachment of a carbon fiber tube and weights to the bow in a cantilever configuration, where the carbon fiber tube comprises a mechanism for preloading the tube to limit oscillation of the tube as weight is provided to the tube.

A variety of different axial load members may be utilized, including a reinforced string, such as a bow string, piano wire, a rod, or other structures which may be axially disposed within a tube. Because the axial load members will typically be placed in tension, thereby placing the tube in compression, the axial load members must have sufficient tensile strength for the applied loading. It is desirable that the axially load members be light weight, have ends which are easily affixed to span between the first end member and the second end member, and be easily replaceable. The axial load member should be adaptable to work cooperatively with the adjustment mechanism to provide a range of load settings to the stabilizer tube.

DETAILED DESCRIPTION OF THE EMBODIMENTS

Figure 1:
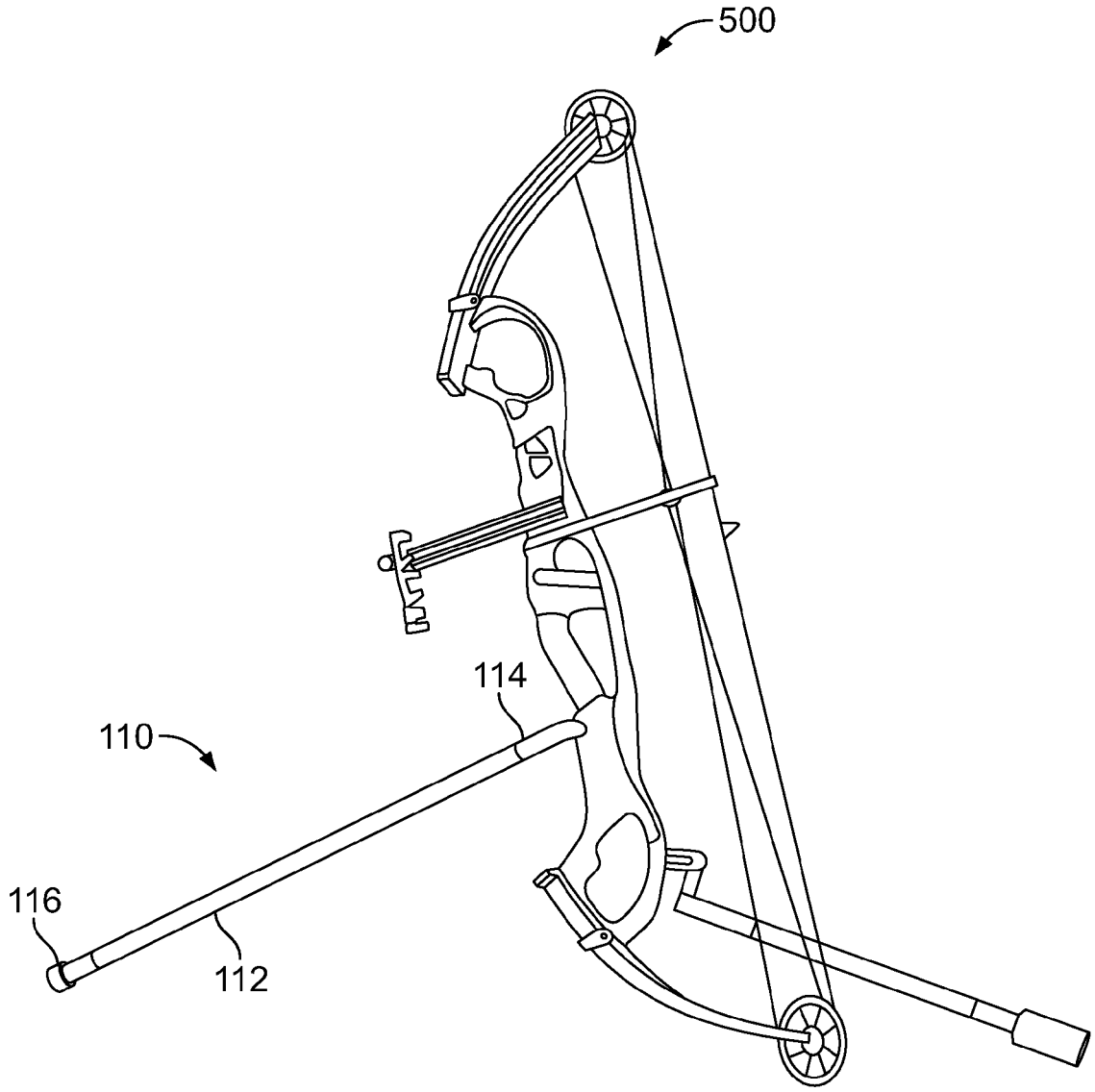
FIG. 1 shows an archery bow equipped with a front stabilizer of the present invention and a side stabilizer.

Referring specifically to the figures, FIG. 1 shows an archery bow 500 equipped with an embodiment of the presently disclosed stabilizer 110. Stabilizer 110 comprises a tube 112, first end member 114 and second end member 116. As discussed above, tube 112 will typically be of carbon fiber construction. Because of the ability to adjust the elastic modulus of the tube by application of loading to the axial load member, if tube 112 is manufactured from carbon fiber, it may have a small diameter and have fewer fiber wraps while still providing the desired stiffness.

Figure 2:
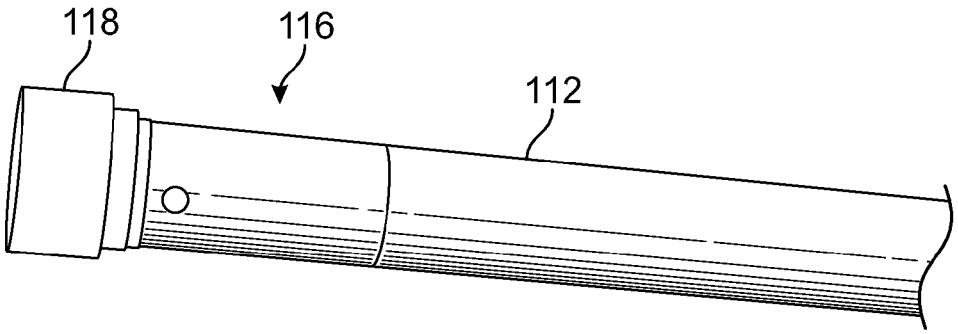
FIG. 2 shows the weight end of the front stabilizer depicted in FIG. 1.

FIG. 2 shows an embodiment of second end member 116 having a weight 118 attached to it. Weight 118 makes up onto threads of a fastener within the second end member 116 as described in greater detail below. It is to be appreciated that other embodiments of the invention utilize internal rather than external weights 118, such as the embodiment depicted in FIGS. 11-12, which utilizes a tube extension 212 which makes up to tube 112, wherein the weights 218 are contained within the tube extension.

Figure 3:
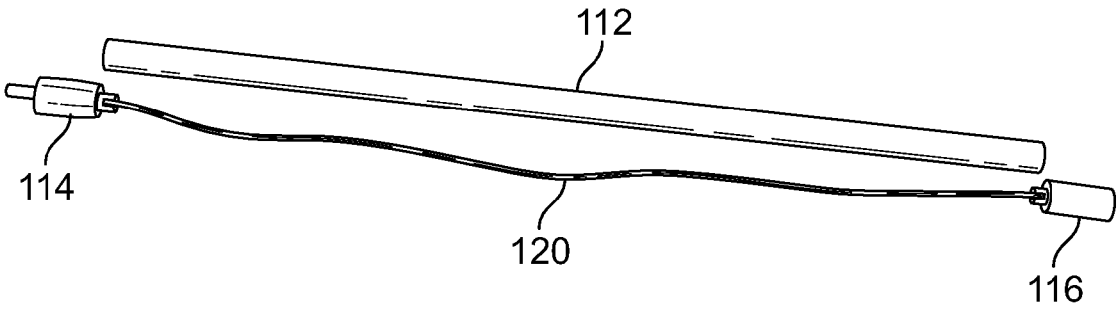
FIG. 3 shows components of an embodiment of the present invention.

FIG. 3 shows the primary components of an embodiment of the present invention, comprising tube 112, first end member 114, second end member 116, with an axial load member, such as string 120, spanning between the first end member and the second end member. It is to be appreciated that in addition to string 120, a variety of different structures may be utilized for the axial load member, including piano wire, rods, and other columnar or cylindrical structures which may either be placed in tension or compression. If a string 120 is utilized as the axial load member, the string may be of the type having a left-hand rotation. Strings of this type may be adjusted by various means including the two independent mechanisms described below. It is to be appreciated that FIG. 3 shows string 120 attached to first end member 114 and second end member 116 as outside of tube 112. However, this figure is for illustration purposes to generally show the relative positions of the components, rather than to depict the actual construction. When assembled, string 120 is inside tube 112 with first end member 114 and second end member 116 affixed on respective ends of the tube.

Figure 4:
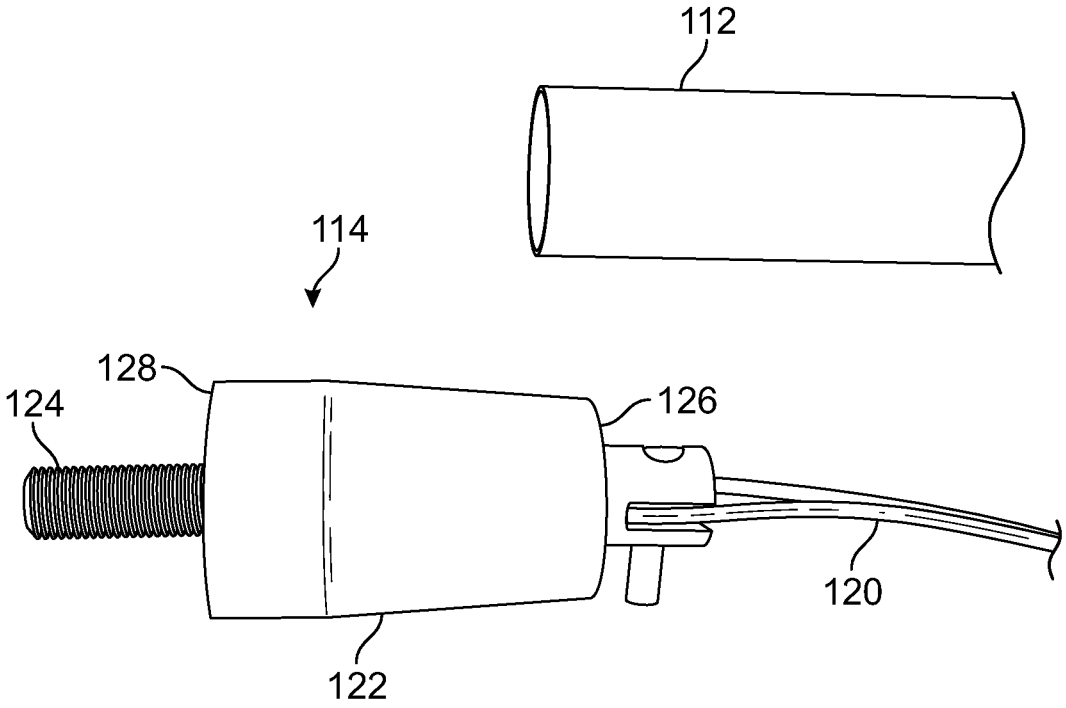
FIG. 4 shows an embodiment of a first end member which attaches to the bow end of the tube.
Figure 5:
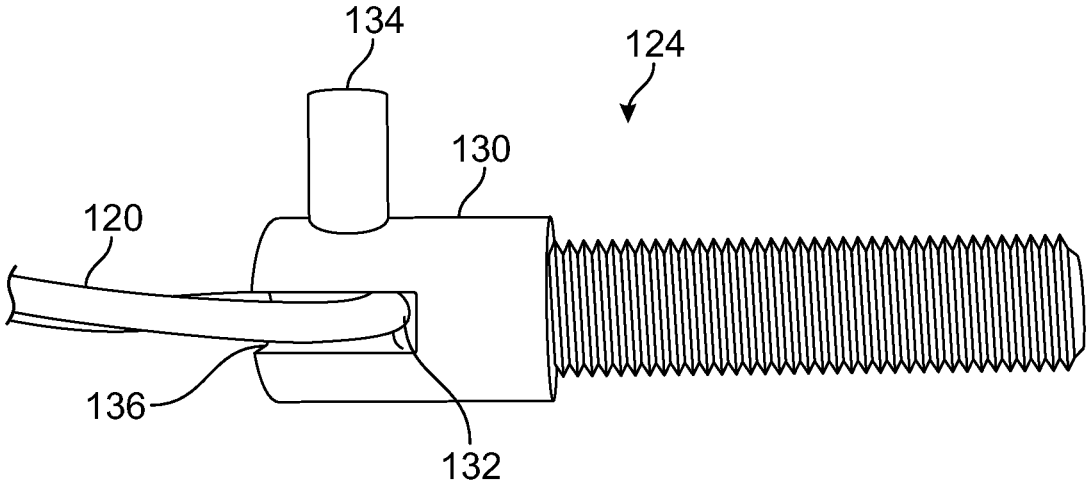
FIG. 5 shows the internal components of an embodiment of the first end member.
Figure 7:
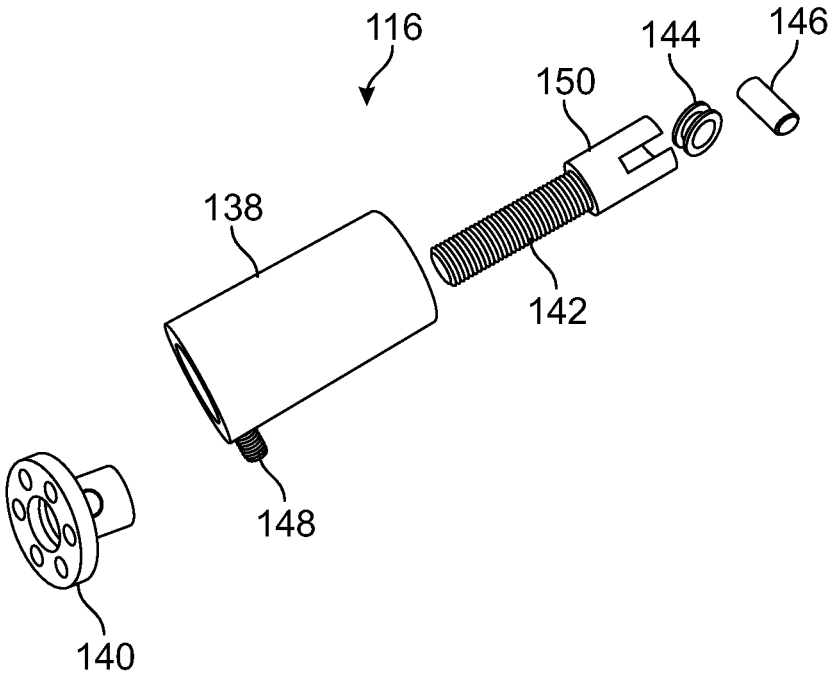
FIG. 7 shows an exploded view of an embodiment of the second end member of FIG. 6.
Figure 8:
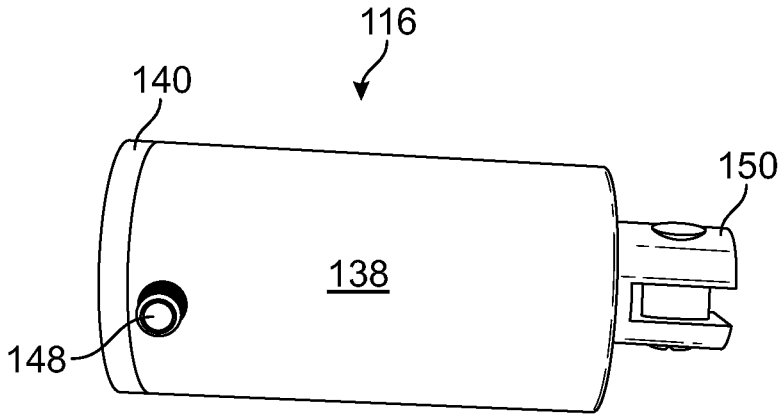
FIG. 8 shows the second end member of FIG. 6 in the closed position with the axial load member removed.
Figure 9:
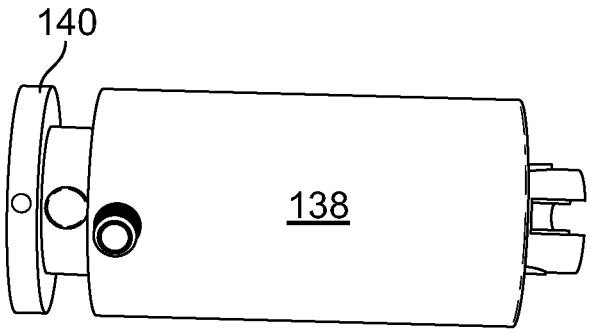
FIG. 9 shows the second end member of FIG. 8 in the open position.

FIG. 4 shows a close up view of an embodiment of first end member 114 adjacent to the end of tube 112 to which it attaches. First end member 114 comprises a body 122 having an axial opening through which threaded fastener member 124 is disposed. Body 122 has a first end 126 which seats over the end of tube 112. Body 122 has a second end 128 which, in conjunction with a portion of threaded fastener member 124, makes up with a connecting member which attaches the stabilizer 110 to the bow 500. FIG. 5 shows the threaded fastener member 124 in greater detail, showing that the threaded fastener has a head 130 which provides an attachment point for an end of the axial load member. As exemplified by FIG. 5, the head 130 may attach to the axial load member, in this example string 120, by means of a combination of slot 132 and retaining pin 134, where pin 134 may be inserted through a loop in the end of string 120. A loop bushing 136 may be utilized, where the loop in the end of string 120 goes around the loop bushing 136 (similar to loop bushing 144 shown in FIG. 7), and pin 134 is inserted through an axial opening in the first loop bushing.

Figure 6:
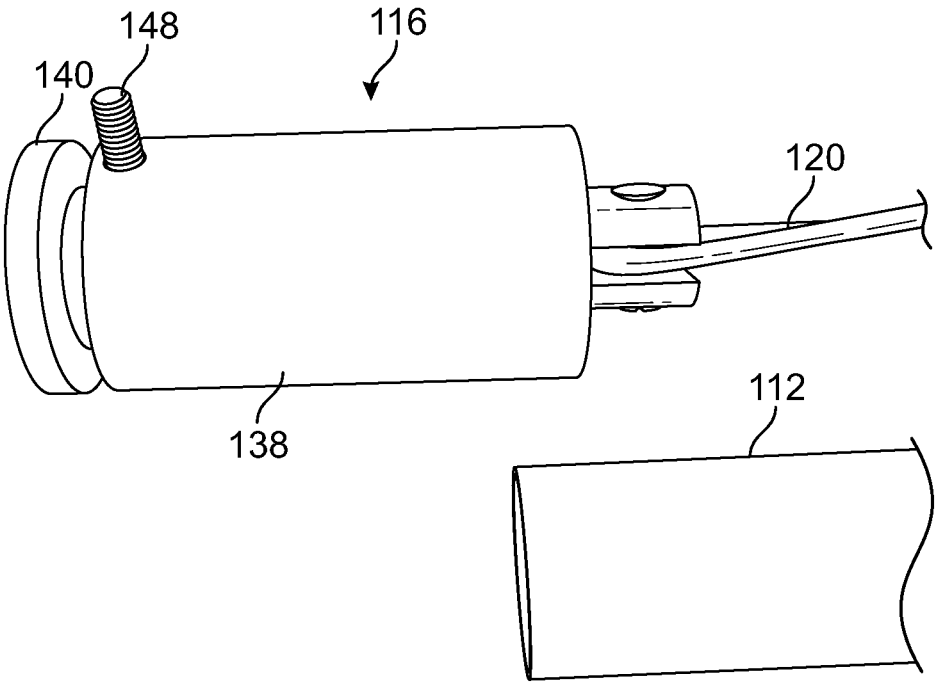
FIG. 6 shows an embodiment of a second end member which attaches to the weight end of the tube, where the second end member comprises an integral adjustment mechanism.
Figure 10:
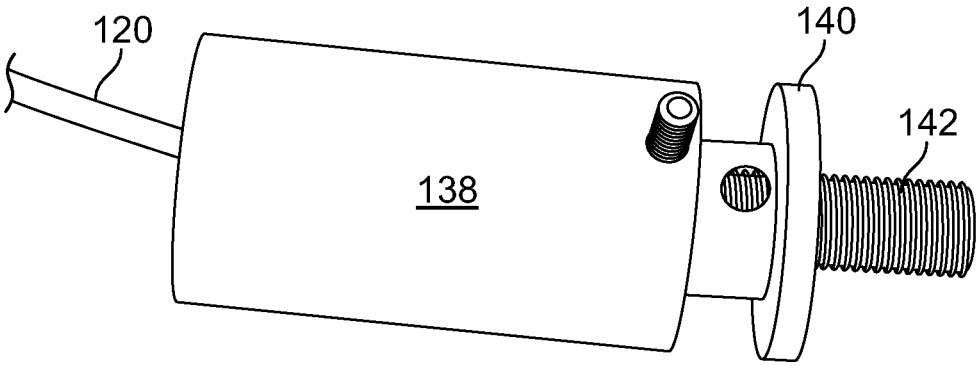
FIG. 10 shows the second end member of FIG. 9 with the floating nut backed out.

FIGS. 6-10 show an embodiment of a second end member 116 which may be utilized with the disclosed stabilizer, in which the second member comprises an integral adjustment mechanism for applying or releasing tension on the axial load member. FIG. 6 shows the second end member 116 adjacent to the end of tube 112 to which it attaches. Second end member 116 may comprise an exterior housing 138 which provides a structure for attachment of the various components of the integral adjustment mechanism. As shown in the exploded view of FIG. 7, these components may comprise exterior housing 138, floating nut 140, adjustment fastener 142, loop bushing 144, second pin 146, and set screw 148. Adjustment fastener 142 has a head 150 to which the axial load member, such as a string 120, may be attached. As shown in FIG. 10, the threads of adjustment fastener 142 extend outward from floating nut 140 such that weight 118, which will typically have a threaded axial opening, may be made up on the threads as depicted in FIG. 2. Adjustments to the axial load member may be made by backing out set screw 148 and rotating floating nut 140. If the axial load member utilized for the device is a string 120 having a left hand rotation, tension may be applied to the string by either rotation of the weight or rotation of the floating nut 140.

Figure 11:
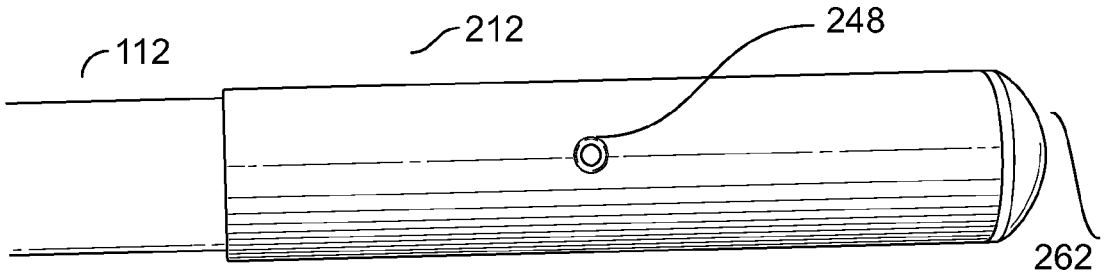
FIG. 11 shows a portion of an embodiment of the present stabilizer, showing a tube extension for containing internal weights.
Figure 12:
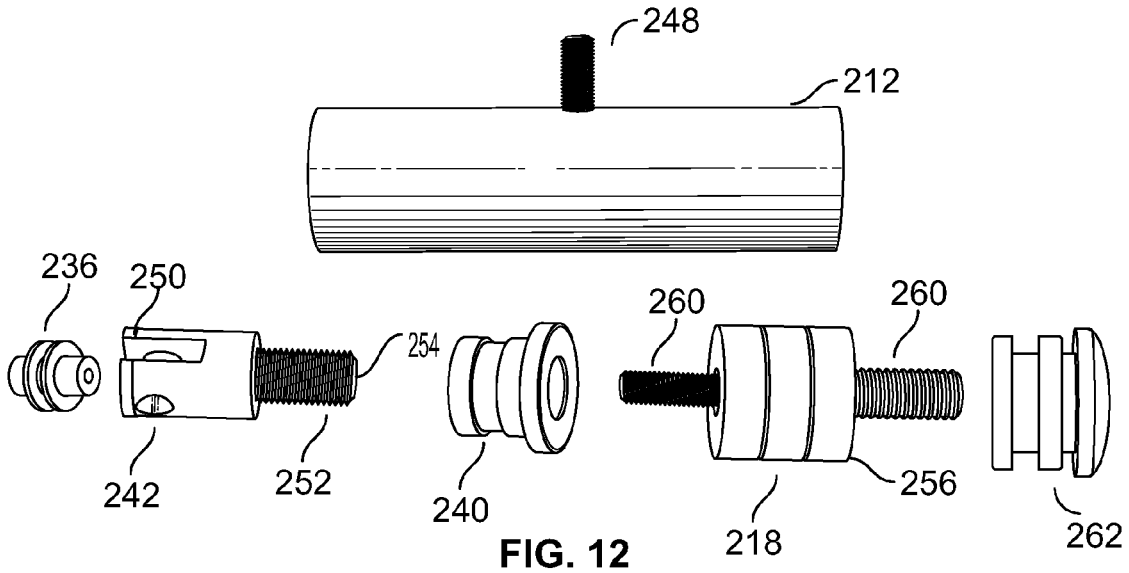
FIG. 12 shows the internal components of the tube extension shown in FIG. 11.

FIGS. 11, 12 depict an alternative embodiment of the device which utilizes internal weights 218 within a tube extension 212 which attaches to the end of the tube 112 in place of second member 116. Contained within tube extension 212 is adjustment fastener 242, which has a head 250 to which the axial load member, such as a string 120, may be attached to a loop bushing 236. An adjustment nut 240 makes up on the threads 252 of adjustment fastener 242. Weights 218 are carried on a double threaded stud 260, which has one end which makes up into end cap 262 and another end upon which weights 218 are carried, and which makes up into a threaded aperture (not shown) on the end 254 of adjustment fastener 242. A spacer 256 may be disposed on double threaded stud 260 between the weights 218 and end cap 262. The adjustment assembly may be maintained in position within tube extension 212 by a set screw 248.

While the above is a description of various embodiments of the present invention, further modifications may be employed without departing from the spirit and scope of the present invention. Thus the scope of the invention should not be limited according to these factors, but according to the following appended claims.

What is claimed is:

1. A bow stabilizer comprising:

a carbon fiber tube comprising a free end and a bow attachment end;

a first end member disposed at the bow attachment end of the carbon fiber tube;

a second end member disposed at the free end of the carbon fiber tube;

an axial load member linearly spanning between the first end member and the second end member; and an adjustment mechanism which is integral to either the first end member or the second end member, wherein the adjustment mechanism changes an amount of tension in the axial load member, wherein an increase in the amount of tension applies an increase of compressive load applied to the carbon fiber tube and a decrease in the amount of tension applies a decrease of compressive load applied to the carbon fiber tube, said adjustment mechanism allowing a user to adjust the elastic modulus of the carbon fiber tube.

2. The bow stabilizer of claim 1 further comprising a weight attached to the free end of the carbon fiber tube.

3. The bow stabilizer of claim 1 wherein the second end member attaches to the free end of the carbon fiber tube.

4. The bow stabilizer of claim 1 wherein the second end member is contained within a tube extension which attaches to the free end of the carbon fiber tube.

5. The bow stabilizer of claim 4 wherein a weight is contained within the tube extension.

6. The bow stabilizer of claim 1 wherein the axial load member is selected from the group consisting of string, wire, and rods.

7. The bow stabilizer of claim 1 wherein the axial load member comprises a string having a left-hand rotation.

8. The bow stabilizer of claim 1 wherein the adjustment mechanism comprises an exterior housing through which a threaded adjustment fastener is inserted, wherein the threaded adjustment fastener has a head to which the axial load member may be attached and a floating nut which is made up on the threads of the threaded adjustment fastener.

9. A method of stabilizing an archery bow comprising the following steps:

attaching a stabilizer to the archery bow, wherein the stabilizer comprises a carbon fiber tube having an attached end, a free end, a weight attachment mechanism, and an adjustable axial loading mechanism;

adding weight to the weight attachment mechanism; and applying axial load to the carbon fiber tube by adjusting the adjustable axial loading mechanism to preload the tube, said adjustable axial loading mechanism allowing a user to adjust the elastic modulus of the carbon fiber tube.

10. The method of claim 9 wherein the weight attachment mechanism provides for attachment of exterior weights at the free end of the carbon fiber tube.

11. The method of claim 9 wherein the axial load is applied by an axial load member spanning between a first end member attached at the attached end of the carbon fiber tube and a second end member attached at the free end of the carbon fiber tube.

12. The method of claim 11 wherein the axial load member is selected from the group consisting of string, wire, and rods.

13. The method of claim 11 wherein the axial load member comprises a string having a left-hand rotation.

14. The method of claim 9 wherein the adjustable axial loading mechanism comprises an exterior housing through which a threaded adjustment fastener is inserted, wherein the threaded adjustment fastener has a head to an axial load member may be attached and a floating nut which is made up on the threads of the threaded adjustment fastener.

* * * * *